US011242725B2

(12) United States Patent
Fripp et al.

(10) Patent No.: US 11,242,725 B2
(45) Date of Patent: Feb. 8, 2022

(54) BRIDGE PLUG APPARATUSES CONTAINING A MAGNETORHEOLOGICAL FLUID AND METHODS FOR USE THEREOF

(71) Applicant: Halliburton Energy Services, Inc., Houston, TX (US)

(72) Inventors: Michael Linley Fripp, Carrollton, TX (US); Jack Gammill Clemens, Fairview, TX (US); Zachary Ryan Murphree, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 51 days.

(21) Appl. No.: 15/308,675

(22) PCT Filed: Sep. 8, 2014

(86) PCT No.: PCT/US2014/054548
§ 371 (c)(1),
(2) Date: Nov. 3, 2016

(87) PCT Pub. No.: WO2016/039719
PCT Pub. Date: Mar. 17, 2016

(65) Prior Publication Data

US 2017/0191341 A1 Jul. 6, 2017

(51) Int. Cl.
*E21B 33/12* (2006.01)
*E21B 33/134* (2006.01)
(Continued)

(52) U.S. Cl.
CPC ..... *E21B 33/1208* (2013.01); *E21B 23/00* (2013.01); *E21B 23/06* (2013.01);
(Continued)

(58) Field of Classification Search
CPC ..... E21B 33/1208; E21B 23/00; E21B 23/06; E21B 33/10; E21B 33/12; E21B 33/134
See application file for complete search history.

(56) References Cited

U.S. PATENT DOCUMENTS 2,767,794 A 10/1956 Lynes
6,047,773 A 4/2000 Zeltmann et al.
(Continued)

FOREIGN PATENT DOCUMENTS

WO 2001061713 A1 8/2001
WO 2016039719 9/2014

OTHER PUBLICATIONS

International Search Report and Written Opinion for PCT/US2014/054548 dated May 29, 2015.

*Primary Examiner* — Waseem Moorad
*Assistant Examiner* — Neel Girish Patel
(74) *Attorney, Agent, or Firm* — McGuireWoods LLP

(57) ABSTRACT

Magnetorheological fluids may regulate fluid flow downhole by forming a fluid seal using a bridge plug apparatus. Bridge plug apparatuses employing a magnetorheological fluid may be deployed in a wellbore in a retrievable configuration or in a substantially permanent configuration. Retrievable bridge plug apparatuses may comprise spaced apart magnets having a gap defined therebetween, and a reservoir of magnetorheological fluid housed within the gap. The magnets move laterally with respect to one another to expand or contract the gap and to displace the reservoir of magnetorheological fluid radially with respect to the magnets. Other bridge plug apparatuses may comprise a flow path extending between a reservoir of magnetorheological fluid and the exterior of a housing, where at least a portion of the flow path is located within a gap defined between spaced apart magnets.

12 Claims, 5 Drawing Sheets

(51) Int. Cl.
*E21B 23/06* (2006.01)
*E21B 23/00* (2006.01)
*E21B 33/10* (2006.01)

(52) U.S. Cl.
CPC ..... *E21B 33/10* (2013.01); *E21B 33/12* (2013.01); *E21B 33/134* (2013.01)

(56) References Cited

U.S. PATENT DOCUMENTS 6,817,415 B2 11/2004 Orban et al.
7,428,922 B2 9/2008 Fripp et al.
7,743,825 B2 * 6/2010 O'Malley ..... E21B 36/00 166/179
8,960,314 B2 * 2/2015 Ramon ..... E21B 33/12 166/387
9,206,659 B2 * 12/2015 Zhang ..... E21B 43/261
9,850,733 B2 * 12/2017 Fripp ..... E21B 33/12
2003/0166470 A1 * 9/2003 Fripp ..... F15B 20/002 507/100
2005/0109512 A1 * 5/2005 Zitha ..... C09K 8/512 166/305.1
2005/0241824 A1 * 11/2005 Burris, II ..... E21B 23/10 166/255.1
2007/0240877 A1 * 10/2007 O'Malley ..... E21B 33/128 166/179
2010/0038074 A1 * 2/2010 Patel ..... E21B 33/1216 166/187
2011/0073329 A1 3/2011 Clemens et al.
2011/0079390 A1 * 4/2011 Themig ..... E21B 33/124 166/285
2011/0094754 A1 * 4/2011 Smart ..... E21B 27/02 166/381
2011/0108277 A1 * 5/2011 Dudley ..... E21B 43/2401 166/308.1
2011/0186297 A1 * 8/2011 Zhang ..... E21B 21/003 166/308.1
2011/0297265 A1 12/2011 Kahoe et al.
2011/0297394 A1 12/2011 VanDelden
2012/0318510 A1 * 12/2012 Ocalan ..... E21B 47/00 166/300
2013/0020066 A1 1/2013 Ocalan et al.
2013/0140023 A1 * 6/2013 Baumann ..... E21B 33/1216 166/281
2013/0192852 A1 * 8/2013 Mazyar ..... E21B 34/08 166/386
2014/0048252 A1 * 2/2014 King ..... E21B 33/128 166/135
2015/0315868 A1 * 11/2015 Fripp ..... E21B 33/1208 166/387
2015/0345250 A1 * 12/2015 Murphree ..... E21B 43/25 166/292
2016/0010424 A1 * 1/2016 van Oort ..... E21B 33/13 166/293
2016/0369596 A1 * 12/2016 McMillon ..... E21B 33/12
2018/0038218 A1 * 2/2018 Hay ..... E21B 47/024
2018/0080302 A1 * 3/2018 Fripp ..... E21B 33/10

* cited by examiner

BRIDGE PLUG APPARATUSES CONTAINING A MAGNETORHEOLOGICAL FLUID AND METHODS FOR USE THEREOF

BACKGROUND

The present disclosure generally relates to operations conducted within a subterranean wellbore, and, more specifically, to bridge plug apparatuses and methods for their use in conducting operations within a subterranean wellbore.

Bridge plug apparatuses are wellbore tools that are typically lowered into a subterranean wellbore to a desired location and then actuated to isolate pressure and restrict fluid flow between one or more subterranean zones. Depending on their intended function, bridge plug apparatuses may be configured to be retrievable or may be deployed in a substantially permanent fashion within a wellbore. Retrievable bridge plug apparatuses are frequently used during drilling and workover operations to provide temporary zonal isolation. Permanently deployed bridge plug apparatuses may be used, for example, when it is desired to shut off a downstream zone of the wellbore while still maintaining operations in an upstream zone. As used herein, the term "upstream" will refer to the portion of a wellbore located between the bridge plug apparatus and the upper terminus of the wellbore. Likewise, as used herein, the term "downstream" will refer to the portion of a wellbore located between the bridge plug apparatus and the lower terminus of the wellbore.

Bridge plug apparatuses are most commonly lowered through the tubing string of the wellbore in order to reach the desired subterranean zone. This allows the bridge plug apparatus to be positioned in the wellbore without removing the tubing string or killing the well. Once positioned and set within the wellbore, the bridge plug apparatus can form a fluid seal therein. If set in the tubing string, the fluid seal can block fluid flow therein, or if set outside the tubing string, the fluid seal can span the width of the wellbore in order to block fluid flow.

Packers are to be distinguished from bridge plug apparatuses in that packers are deployed with a tubing string and form a fluid seal on the exterior of the tubing string (i.e., within the annulus of the wellbore). In addition, packers generally allow at least one-way fluid flow within the wellbore, whereas bridge plug apparatuses are intended to block fluid flow in both directions.

Conventional bridge plug apparatuses utilize a series of stacked elastomeric seals that are mechanically compressed together when setting the bridge plug to form a fluid seal. Compression expands the seals outwardly in order to form the fluid seal. Because bridge plug apparatuses need to fit within the tubing string in order to reach their deployment location, they are relatively small in diameter. Particularly when deploying a bridge plug apparatus downstream of the tubing string, the elastomeric seals may need to outwardly expand a considerable distance in order to reach the walls of the wellbore and form a fluid seal. In such applications, the expansion distance can sometimes be greater than about two times the initial diameter of the bridge plug apparatus itself.

Bridge plug apparatuses operating by compression-induced expansion of an elastomeric material can present a number of challenges. The significant expansion distance to be spanned by the elastomeric material can tax its expandability limits and sometimes result in inadequate formation of a fluid seal. For wellbores that are out-of-round or have low mechanical strength, conditions which are fairly common later in the wellbore's life, it can be difficult to form an effective fluid seal with a conventional bridge plug apparatus. For example, compression forces exerted upon the wellbore during setting of conventional bridge plug apparatuses may damage casing below the tubing string that is old, corroded, or otherwise damaged. Anchoring of the expanded elastomeric material to the walls of the wellbore and chemical stability of the elastomeric material in the downhole environment may also be an issue. For retrievable bridge plug apparatus configurations, compression setting of the elastomeric material upon extended deployment can sometimes result in incomplete elastic recoil, making it problematic to withdraw the bridge plug apparatus from the wellbore. Run-in speed of conventional bridge plug apparatuses can also be limited due to swabbing.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, as will occur to one having ordinary skill in the art and the benefit of this disclosure.

DETAILED DESCRIPTION

Figure 1C:
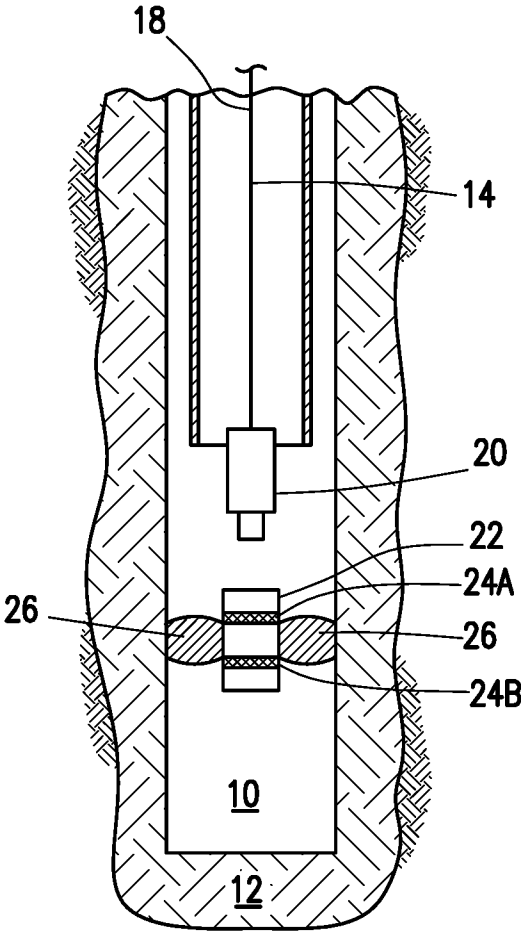
FIGS. 1A-1C show schematics illustrating the deployment of a bridge plug apparatus containing a magnetorheological fluid.

The present disclosure generally relates to operations conducted within a subterranean wellbore, and, more specifically, to bridge plug apparatuses and methods for their use in conducting operations within a subterranean wellbore.

One or more illustrative embodiments incorporating the features of the present disclosure are presented herein. Not all features of a physical implementation are necessarily described or shown in this application for the sake of clarity. It is to be understood that in the development of a physical implementation incorporating the embodiments of the present disclosure, numerous implementation-specific decisions may be made to achieve the developer's goals, such as compliance with system-related, business-related, government-related and other constraints, which may vary by implementation and from time to time. While a developer's efforts might be time-consuming, such efforts would be, nevertheless, a routine undertaking for one having ordinary skill in the art and the benefit of this disclosure.

As discussed above, conventional bridge plug apparatuses operating through expansion of an elastomeric material can be problematic in several aspects. Particularly for through-tubing deployment of the bridge plug apparatuses, the elastomeric material may need to expand across a significant fraction of the wellbore's width diameter. Incomplete or irregular expansion of the elastomeric material, or irregular shape of the wellbore may result in inadequate formation of a fluid seal. Chemical instability of the elastomeric material in the downhole environment may also be problematic in some instances.

As a solution to the shortcomings exhibited by conventional bridge plug apparatuses, a modified sealing protocol was developed for use in conjunction with these wellbore tools. The modified sealing protocol is based upon displacement and subsequent viscosification of a magnetorheological fluid in order to form a temporary or substantially permanent barrier within a wellbore. As used herein, the term "magnetorheological fluid" will refer to a composition comprising a plurality of magnetically responsive particles that are disposed in a carrier fluid. Specifically, the bridge plug apparatuses disclosed herein utilize a magnetic field to change the rheological properties of the magnetorheological fluid from a first viscosity state to a second viscosity state as the magnetorheological fluid is displaced. The displacement of the magnetorheological fluid can be reversible in some embodiments, thereby allowing some configurations of the bridge plug apparatuses to be retrievable from or resettable within the wellbore, if desired. Non-reversible displacement of the magnetorheological fluid is also possible in some embodiments. Such configurations of the bridge plug apparatuses may be used for substantially permanent deployment within the wellbore. Further disclosure on the characteristics of suitable magnetorheological fluids for each type of deployment condition is provided hereinbelow.

More particularly, the bridge plug apparatuses described herein provide a magnetorheological fluid in a low first viscosity state while being conveyed into the wellbore. Once deployed to a desired location in the wellbore, the bridge plug apparatuses are configured to displace the magnetorheological fluid from its initial location within the bridge plug apparatuses. In the process of being displaced from its initial location, the magnetorheological fluid is exposed to a magnetic field that differs from that present in the initial location. The altered magnetic field results in a change in viscosity of the magnetorheological fluid from the low first viscosity state to a second viscosity state, specifically a higher second viscosity state. The increased viscosity can result in gelation or solidification of the magnetorheological fluid, thereby allowing the magnetorheological fluid to form a robust barrier within the wellbore in some embodiments. In various configurations, the magnetic field may be altered by changing the physical location of permanent magnets within the bridge plug apparatuses, changing the magnetic field of fixed or movable electromagnets within the bridge plug apparatuses, or any combination thereof. In other various configurations, the bridge plug apparatuses may displace the magnetorheological fluid to a location where the magnetorheological fluid experiences a magnetic field differing from that of its initial location. Similarly, the magnetorheological fluid may also be pumped into the wellbore separately from the bridge plug apparatus and undergo viscosification upon reaching a magnet housed within the bridge plug apparatus. Various embodiments of each configuration are discussed in further detail hereinbelow.

Advantageously, the bridge plug apparatuses described herein may be configured for both retrievable deployment conditions and substantially permanent deployment conditions in a wellbore. Both apparatus configurations can be configured so that they can be conveyed through a tubing string to a desired location within the wellbore. Although they both utilize a magnetorheological fluid in forming a fluid seal, the magnetorheological fluid used in the various bridge plug apparatus configurations may, in some embodiments, be chosen to better support the particular deployment motif, as discussed hereinafter.

Retrievable deployment configurations may involve at least partially removing the altered magnetic field that resulted in transformation of the magnetorheological fluid from the first viscosity state into the second viscosity state. Further altering the magnetic field in this manner may convert the magnetorheological fluid into a third viscosity state with a lower viscosity, which need not necessarily be the same as the first viscosity state. That is, retrievable deployment configurations advantageously allow the altered magnetic field condition that resulted in viscosification of the magnetorheological fluid to be "reversed." This allows deviscosification to occur. Deviscosification allows removal of the barrier formed from the magnetorheological fluid to take place. In some embodiments, the magnetorheological fluid may be housed in a deformable container to better take advantage of the reversible viscosification/deviscosification process. By containing the magnetorheological fluid in this manner, the bridge plug apparatuses may be reused in a subsequent process. Although it is not a requirement for removal and reuse of such bridge plug apparatuses to take place, the ability to remove the bridge plug apparatuses and subsequently reuse them represents an advantageous feature from a cost of goods standpoint. Moreover, the formation of only a temporary barrier in a wellbore is sometimes desirable.

Non-retrievable or substantially permanent deployment configurations can involve displacing the magnetorheological fluid into a location where the magnetic field is sufficient to convert the magnetorheological fluid from the first viscosity state into the second viscosity state. The magnetorheological fluid remains in a fluidized state until reaching the location where the magnetic field is present. Upon exposure to the magnetic field, the magnetorheological fluid undergoes viscosification and its ability to undergo further displacement is limited. For example, the magnetorheological fluid may solidify upon reaching the location where the magnetic field is present. If there is no way to remove the magnetic field from the magnetorheological fluid following viscosification, or vice versa, this deployment configuration allows a permanent barrier to be formed from the magnetorheological fluid in the wellbore. For example, if the magnetorheological fluid is not housed in a container when dispensed into the wellbore, there may be no effective way to withdraw the magnetorheological fluid from the magnetic field and to recover the deviscosified magnetorheological fluid.

Both deployment configurations of the bridge plug apparatuses of the present disclosure allow a barrier to be formed within a wellbore. Once the barrier is in place, various subterranean operations may be conducted subsequently such that a fluid does not pass from one side of the barrier to the other. For example, production may take place from the upstream side of the barrier, or servicing of the wellbore may be conducted. Additionally, a further sealing operation, such as cementing above the barrier, may optionally be conducted, particularly when using substantially permanent deployment configurations. Increased durability of the barrier formed in substantially permanent deployment configurations may allow time for setting of a further sealant, such as cement, to take place within the wellbore. For example, in substantially permanent deployment configurations, a component of a magnetorheological sealant may undergo a chemical reaction to further strengthen a fluid seal formed from the magnetically responsive particles of the magnetorheological fluid. In this sense, the magnetically responsive particles can promote dispensation of the chemically reactive component to a desired location in a wellbore.

In addition to the foregoing features, the bridge plug apparatuses of the present disclosure are believed to present several advantages over those that are presently used in the art. Foremost, the bridge plug apparatuses of the present disclosure allow much greater diametric expansion of a barrier within the wellbore, since the magnetic fields used to promote viscosification may reach much further than the presently used elastomeric materials can expand. The significant reach of the magnetorheological fluids within the wellbore may allow the bridge plug apparatuses of the present disclosure to remain small in size, thereby facilitating their transit through a tubing string without generating adverse swabbing effects.

Increased uniformity of the barrier and conformance of the barrier with the walls of the wellbore may also be realized with a magnetorheological fluid. Even a solidified magnetorheological fluid may still represent a viscoelastic solid, thereby promoting a high degree of surface conformance in a wellbore, but without putting undue strain on a casing therein. Elastomeric seals, in contrast, are considerably more rigid and may form a less effective fluid seal, particularly when irregular wellbore surfaces are present. The chemical and thermal stability of elastomeric materials may also be inferior to magnetorheological fluids of the present disclosure.

Finally, as discussed above, magnetorheological fluids are further advantageous, since they can be incorporated in bridge plug apparatus configurations that are suitable for both retrievable or substantially permanent deployment configurations in a wellbore. Tailoring of the magnetorheological fluid for both configurations may further take place.

In some embodiments, bridge plug apparatuses of the present disclosure may comprise spaced apart magnets having a gap defined therebetween, and a reservoir of magnetorheological fluid housed within the gap. The magnets move laterally with respect to one another to expand or contract the gap and to displace the reservoir of magnetorheological fluid radially with respect to the magnets. Such bridge plug apparatuses may be deployed in a substantially permanent configuration in a wellbore. However, such bridge plug apparatuses may also be deployed in a retrievable configuration within a wellbore, since the magnets are configured to move laterally back and forth to adjust the viscosity state of the magnetorheological fluid at a desired time. The bridge plug apparatuses may be deployed in a wellbore having any configuration, such as a substantially horizontal or a substantially vertical wellbore.

Figure 1B:
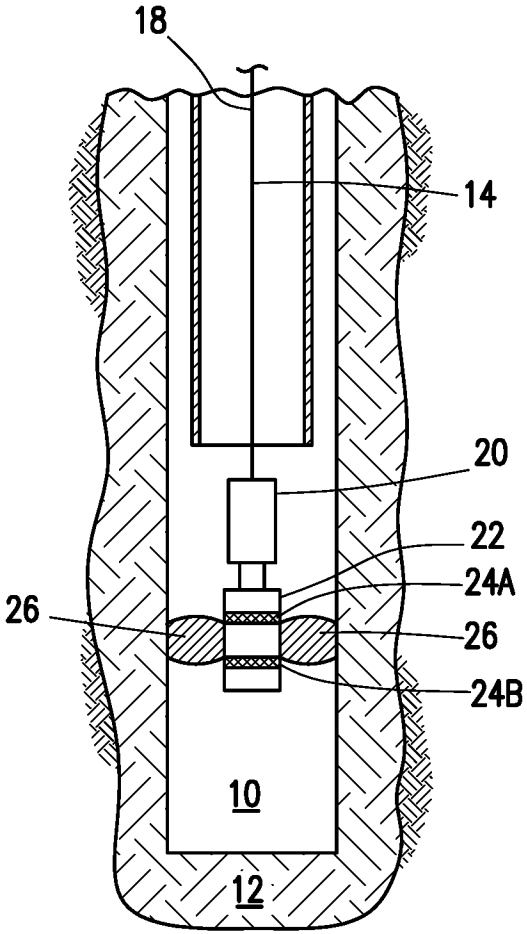
Figure 1A:
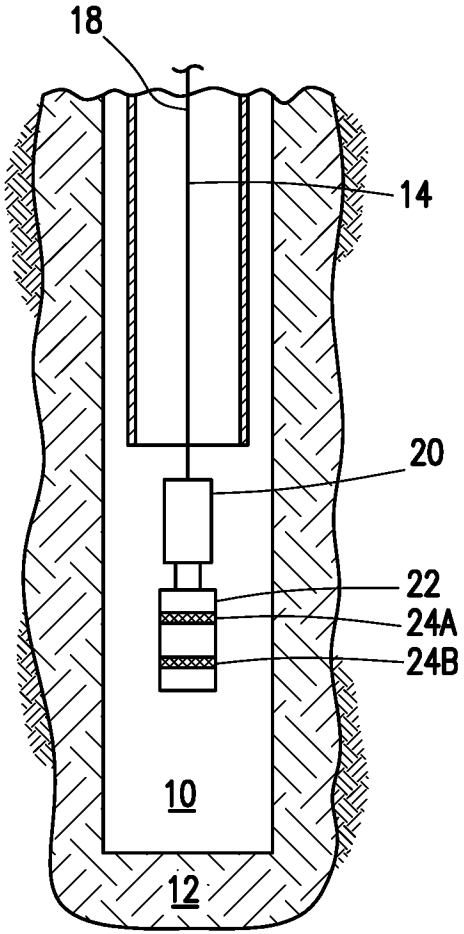

FIGS. 1A-1C show schematics illustrating the deployment of a bridge plug apparatus containing a magnetorheological fluid. As shown in FIGS. 1A-1C, wellbore 10 penetrates subterranean formation 12. Within wellbore 10, tubing string 14 is present. Wireline 18 extends through tubing string 14, and at the end of wireline 18 are setting assembly 20 and bridge plug apparatus 22. As discussed herein, deployment modalities other than wireline deployment are also possible. Setting assembly 20 and bridge plug apparatus 22 are operationally coupled to one another to provide for actuation of bridge plug apparatus 22. In the embodiments of the present disclosure, magnets 24A and 24B are present on or within bridge plug apparatus 22 in a spaced apart configuration. Particular spaced apart configurations for magnets 24A and 24B are described in the ensuing figures. Single magnet configurations are also possible. Wellbore 10 may be cased or uncased in the location where bridge plug apparatus 22 is deployed.

As shown in FIG. 1B, upon actuation of bridge plug apparatus 22, a magnetorheological fluid is displaced from bridge plug apparatus 22 into wellbore 10. The displaced magnetorheological fluid may be constrained within a container or unconstrained when released into wellbore 10 (see ensuing figures). Upon being displaced into wellbore 10, the magnetorheological fluid interacts with the magnetic fields produced by magnets 24A and 24B and undergoes an increase in viscosity, thereby forming barrier 26 within wellbore 10. Once barrier 26 has been established within wellbore 10, setting assembly 20 may then be disengaged from bridge plug apparatus 22, as depicted in FIG. 1C, leaving bridge plug apparatus 22 behind within wellbore 10. Setting assembly 20 can accutate bridge plug apparatus 22 by any suitable technique, such as mechanical, electrical, or pneumatic compression, for example. Bridge plug apparatus 22 and barrier 26 together form a fluid seal within wellbore 10.

Deployed bridge plug apparatus 22 in FIG. 1C may be left permanently in place within wellbore 10, or it may be retrieved at a later time, such as after performing a wellbore servicing operation or after producing a subterranean zone upstream of barrier 26. Any type of wellbore servicing operation or well treatment may be conducted with barrier 26 in place, and illustrative wellbore servicing operations that may be suitable for a particular situation will be familiar to one having ordinary skill in the art. Retrieval of bridge plug apparatus 22 may be accomplished, for example, by reconnecting setting assembly 20 or another appropriate wellbore tool to bridge plug apparatus 22 and altering the magnetic field about the magnetorheological fluid to promote its deviscosification. Following deviscosification, bridge plug apparatus 22 may be withdrawn from wellbore 10. For retrievable configurations, bridge plug apparatus 22 may be designed in order to promote alteration of the magnetic field, as discussed further below.

Although bridge plug apparatus 22 may be configured to be either retrievable or permanently deployable within wellbore 10, it is to be recognized that retrievable configurations may be left permanently in wellbore 10 at an operator's discretion. For example, a retrievable bridge plug apparatus 22 may be left permanently in wellbore 10 if the economics of retrieval would preclude its recovery. Some non-retrievable bridge plug apparatus configurations do not allow alteration of the magnetic field to promote recovery. Non-retrievable bridge plug apparatus configurations, for example, may be used for forming a permanent fluid seal within wellbore 10, such as by performing a cementing operation upstream of the fluid seal formed by barrier 26. For example, in some embodiments, cement can be applied to an upstream face of the fluid seal produced by barrier 26, thereby providing a robust surface upon which curing of the cement can take place. Such cementing operations can take place in plug-and-abandon operations, for example.

Although FIGS. 1A-1C have shown deployment of bridge plug apparatus 22 below or downstream of tubing string 14, it is also to be recognized that deployment within tubing string 14 is also within the scope of the present disclosure. When deployed within tubing string 14, the magnetorheological fluid has less distance over which to expand when forming barrier 26. Moreover, although FIGS. 1A-1C have depicted a wireline deployment modality, it is to be recognized that alternative deployment modalities such as, for example, coiled tubing, jointed tubing, slickline and electric line deployment are also possible. Pump-in deployment of the magnetorheological fluid is also possible in alternative configurations.

Figure 2A:
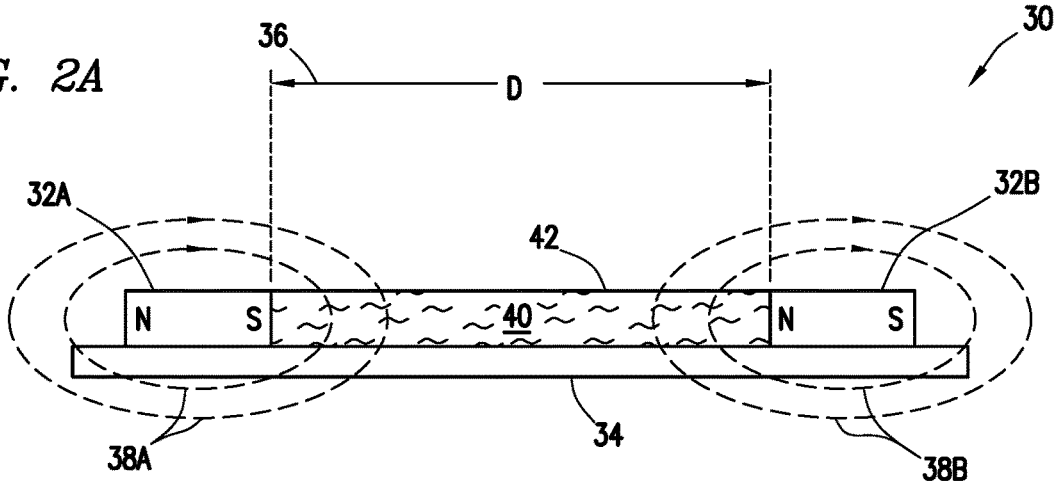
FIGS. 2A-2C show schematics of a bridge plug apparatus that radially displaces a magnetorheological fluid therefrom through lateral movement of spaced apart magnets.
Figure 2B:
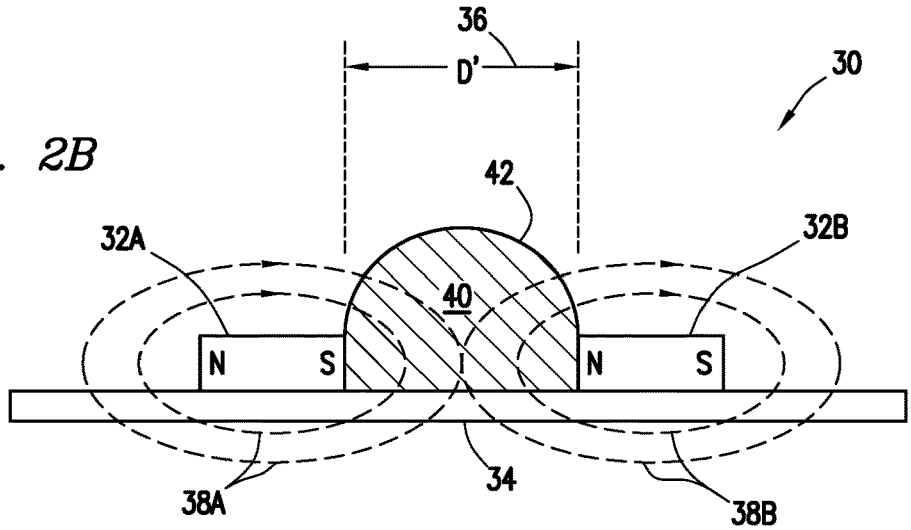
Figure 2C:
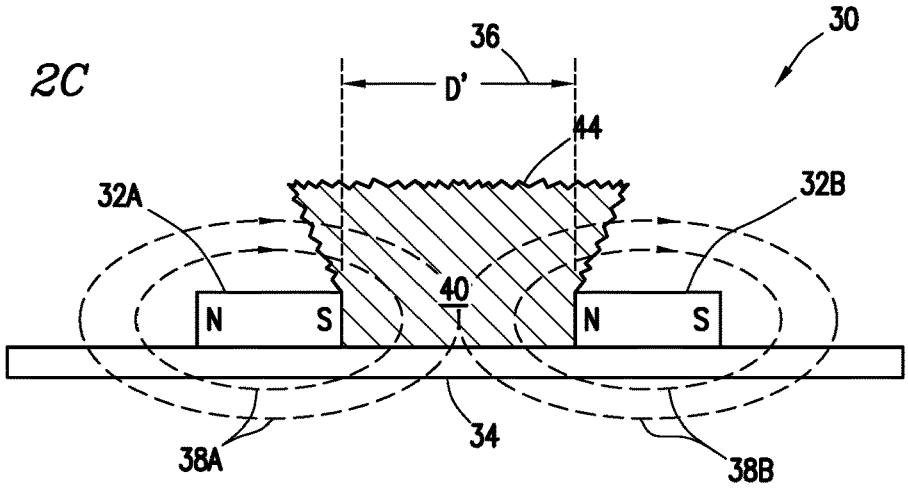

FIGS. 2A-2C show schematics of a bridge plug apparatus that radially displaces a magnetorheological fluid therefrom through lateral movement of spaced apart magnets. FIG. 2A shows the configuration of bridge plug apparatus 30 before viscosification of the magnetorheological fluid has taken place, and FIGS. 2B-2C show possible configurations afterward. As depicted in FIG. 2A, bridge plug apparatus 30 contains magnets 32A and 32B that are laterally movable upon mounting 34. Magnets 32A and 32B are spaced apart from one another, thereby defining gap 36 therebetween in which the separation distance is D in FIG. 2A. Separation distance D leaves magnetic flux lines 38A and 38B produced by magnets 32A and 32B, respectively, spaced sufficiently far apart to leave a magnetorheological fluid in a low viscosity or fluent state when housed between magnets 32A and 32B. Although FIGS. 2A-2C have depicted the opposite poles of magnets 32A and 32B facing each other, it is to be recognized that other configurations are possible and like poles may face each other in other various embodiments. In FIG. 2A, bridge plug apparatus 30 contains a reservoir 40 of magnetorheological fluid housed behind reservoir barrier 42. As indicated above, at separation distance D in FIG. 2A, the magnetorheological fluid is a low viscosity or fluent state.

Referring now to FIGS. 2B and 2C, upon lateral movement of magnets 32A and 32B toward one another, gap 36 shortens to a separation distance D', thereby compressing the magnetorheological fluid therein. The compression force exerted within gap 36 radially displaces reservoir 40 of magnetorheological fluid radially outward with respect to magnets 32A and 32B. That is, the compression force extrudes the magnetorheological fluid from gap 36. Shortening gap 36 to separation distance D' moves magnetic flux lines 38A and 38B closer to one another, and if separation distance D' becomes sufficiently short, they may be close enough to one another to increase the viscosity of the magnetorheological fluid to a second viscosity state having a higher viscosity. In some embodiments, solidification of the magnetorheological fluid can occur.

Upon displacement from gap 36, the magnetorheological fluid may remain contained (FIG. 2B) behind or within reservoir barrier 42. Alternatively, the magnetorheological fluid may be released from reservoir barrier 42 (FIG. 2C). In some embodiments, reservoir barrier 42 may be deformable and expand outwardly with the magnetorhelogical fluid, thereby leaving the magnetorheological fluid contained therein. Such a configuration is depicted in FIG. 2B, and further details are provided in the more specific embodiment depicted in FIGS. 3A and 3B. In other embodiments, a rigid reservoir barrier 42 may be configured to pivot or otherwise move outwardly in response to the decreased separation distance D'.

In other embodiments, reservoir barrier 42 may break or degrade, in whole or in part, upon application of the compression force, thereby releasing the magnetorheological fluid from gap 36. Such a configuration is depicted in FIG. 2C, where the magnetorheological fluid is unconstrained once released from gap 36. For example, in some embodiments, reservoir barrier 42 may shatter in response to the compression force shortening gap 36 to distance D'. In some or other embodiments, a rupture disk (not shown) within reservoir barrier 42 may provide for release of the magnetorheological fluid upon compression. Though no longer constrained by reservoir barrier 42 in FIG. 2C, the magnetorheological fluid may still form viscosified mass 44 upon interaction with magnetic fields 38A and 38B, as discussed above. Viscosified mass 44 may be used to form a fluid seal in a wellbore, as described in more detail above.

The viscosification of the magnetorheological fluid from bridge plug apparatus 30 may be reversed, if desired, by moving magnets 32A and 32B apart from one another. Moving magnets 32A and 32B apart from one another decreases the compression force and lessens the degree to which magnetic fields 38A and 38B interact with the displaced magnetorheological fluid. Magnets 38A and 38B may automatically slidably retract upon releasing the compression force, or an opposite compression force may be applied mechanically, electrically, or pneumatically, for example. With the lowering of the compression force and the magnetorheological fluid's viscosity, the magnetorheological fluid can then be at least partially drawn back into gap 36. Magnets 32A and 32B may be moved to original separation distance D to promote restoration of the first viscosity state, or they may be moved to a separation distance that is intermediate between D and D'. At an intermediate separation distance, the magnetorheological fluid may be in a third viscosity state that has a viscosity between that of the first viscosity state and the second viscosity state. The third viscosity state, for example, may still be sufficiently low to promote at least partial withdrawal of the magnetorheological fluid into gap 36. In configurations where the magnetorheological fluid remains confined behind reservoir barrier 42, bridge plug apparatus 30 may be recovered from or relocated within a wellbore in which bridge plug apparatus 30 has been deployed. Bridge plug apparatus 30 may thereafter be used to directly form a fluid seal in the same wellbore or a different wellbore. If reservoir barrier 36 is no longer intact, the magnetorheological fluid may not be withdrawn back into gap 36 when magnets 32A and 32B are moved apart from one another. For example, the magnetorheological fluid may be lost to the wellbore. Although such configurations of bridge plug apparatus 30 may not be used directly in forming another fluid seal, they may still be recovered, if desired, and recharged with fresh magnetorheological fluid following replacement or repair of reservoir barrier 36.

Figure 3A:
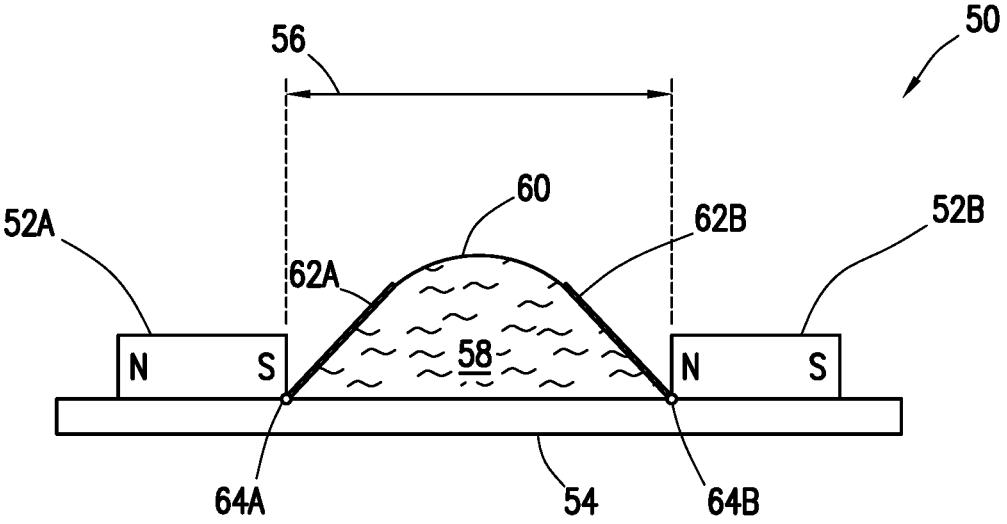
FIGS. 3A and 3B show schematics of a bridge plug apparatus that radially displaces a magnetorheological fluid into a deformable container through lateral movement of spaced apart magnets.
Figure 3B:
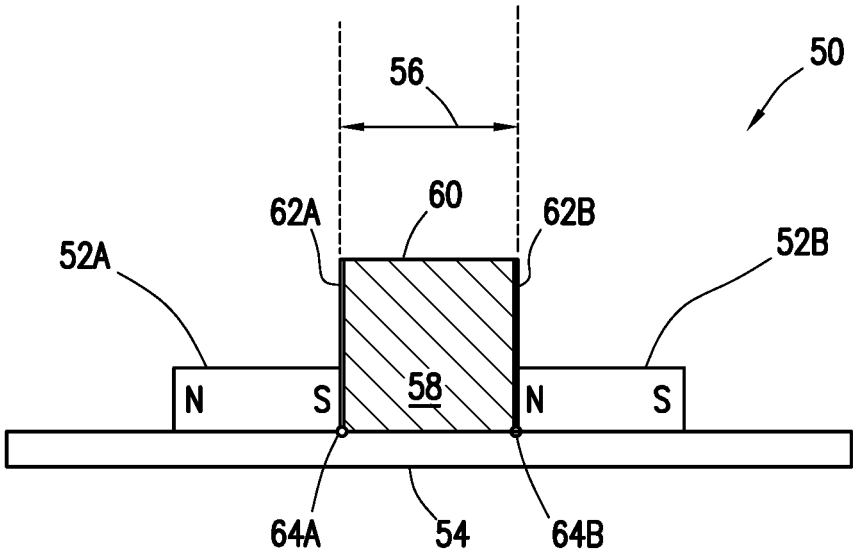

In more specific embodiments, the reservoir of magnetorheological fluid in a retrievable bridge plug apparatus may be housed in a deformable container within the gap. FIGS. 3A and 3B show schematics of a bridge plug apparatus that radially displaces a magnetorheological fluid into a deformable container through lateral movement of spaced apart magnets. FIG. 3A shows the configuration of bridge plug apparatus 50 before viscosification of the magnetorheological fluid and FIG. 3B shows the configuration afterward.

As depicted in FIG. 3A, magnets 52A and 52B are spaced apart on mounting 54 and move laterally with respect to one another. Mounting 54 may be configured in any suitable way to allow magnets 52A and 52B to move laterally with respect to one another. In some embodiments, magnets 52A and 52B can move slidably upon the application of a mechanical force. For example, compressive load can be applied to mounting 54 to expand or contract gap 56. In other embodiments, an electrical, pneumatic, or like actuation mechanism can be used to expand or contract gap 56.

In gap 56 defined between magnets 52A and 52B is disposed reservoir 58 of magnetorheological fluid housed within deformable container 60. In the initial configuration depicted in FIG. 3A, the magnetorheological fluid is in a low viscosity or fluent state due to the separation of magnets 52A and 52B from one another. Due to the minimal compression force present in the initial configuration of FIG. 3A, reservoir 58 maintains a fairly compact size, which allows bridge plug apparatus 50 to pass through confined spaces, such as the interior of a tubing string. As depicted in FIG. 3B, upon moving magnets 52A and 52B toward one another, the magnetorheological fluid is compressed and deformable container 60 is outwardly displaced from gap 56 in a radial fashion with respect to magnets 52A and 52B. As discussed above, upon moving magnets 52A and 52B sufficiently close to one another, the magnetorheological fluid undergoes viscosification and possibly solidification upon being displaced from gap 56.

In bridge plug apparatus 50, a support structure may be affixed to at least one of the magnets. The support structure may restrict axial movement of the deformable container as it is displaced from gap 56. As used herein, the terms "axial" and "lateral" will be used synonymously with one another and will refer to the relative direction of motion of the spaced apart magnets. The support structure also restricts axial movement of the magnetorheological fluid as a result. Because the support structure is affixed to at least one of the magnets, the support structure is also movable in at least a lateral fashion. In more specific embodiments, the support structure may pivot as the deformable container expands or contracts upon lateral movement of the magnets with respect to one another.

With continued reference to FIGS. 3A and 3B, support structures 62A and 62B are affixed to magnets 52A and 52B, respectively. As depicted in FIGS. 3A and 3B, support structures 62A and 62B are configured to pivot about pivot points 64A and 64B, respectively. For retrieval purposes, the pivoting process may be reversible. In the non-displaced state of FIG. 3A, support structures 62A and 62B can rest lightly upon deformable container 60, or deformable container 60 can remain fully below support structures 62A and 62B. In the latter configuration, support structures 62A and 62B may lie generally parallel to mounting 54 in some embodiments. In either case, support structures 62A and 62B may not greatly increase the outer dimensions of bridge plug apparatus 50 when undeployed, as depicted in FIG. 3A, thereby allowing bridge plug apparatus 50 to maintain a compact state for introduction into a wellbore.

Upon reaching a desired location in a wellbore, magnets 52A and 52B can be moved laterally toward one another, thereby compressing the magnetorheological fluid and outwardly displacing the magnetorheological fluid and deformable container 60. In order to better position the displaced magnetorheological fluid, support structures 62A and 62B also pivot outwardly to accommodate the outward expansion of the magnetorheological fluid. For example, in some embodiments, support structures 62A and 62B may comprise petal plates that unfurl in response to the outward displacement of the magnetorheological fluid. Support structures 62A and 62B may constrain the magnetorheological fluid within a region where the magnetic fields of magnets 52A and 52B maintain the magnetorheological fluid in a state of increased viscosity, particularly a solidified state. In addition, support structures 62A and 62B provide additional pressure holding capabilities within a wellbore by maintaining the magnetorheological fluid in a desired shape and providing additional mechanical stabilization thereto.

As discussed above, once it is desired to retrieve or move bridge plug apparatus 50, magnets 52A and 52B can be moved apart from one other to allow the magnetorheological fluid to withdraw into gap 56. As the magnetorheological fluid and deformable container 60 retract from their expanded state, support structures 62A and 62B may pivot in the opposite direction to retract as well, thereby placing bridge plug apparatus 50 again in a compact state for movement through confined spaces, such as the interior of a tubing string. Withdrawal of the magnetorheological fluid and deformable container 60 results in removal of the fluid seal created upon initial displacement of the magnetorheological fluid.

Still other embodiments of the bridge plug apparatuses of the present disclosure may have their spaced apart magnets present in a fixed configuration. In some embodiments, bridge plug apparatuses of the present disclosure may comprise: a housing containing a reservoir of magnetorheological fluid; a flow path extending between the reservoir and an exterior surface of the housing, the flow path fluidly connecting the reservoir to the exterior surface; a barrier located within the flow path that temporarily blocks the flow path; and spaced apart magnets disposed within the housing and having a gap defined therebetween, at least a portion of the flow path being located within the gap defined between the magnets. The bridge plug apparatus is configured to pass through the interior of a tubing string within a wellbore. Since the magnets are in a fixed configuration in such bridge plug apparatuses, they may be more suitable for more permanent deployment within a wellbore. Again, such bridge plug apparatus configurations may be used in a wellbore of any configuration.

In alternative configurations, a single magnet may provide a similar effect within a wellbore, provided that the wellbore is non-horizontal and the magnetorheological fluid has a different density than another fluid present in the wellbore, such as a wellbore fluid. Most typically, the magnetorheological fluid has a greater density than a wellbore fluid and sinks as a result. In such embodiments, the magnetorheological fluid is displaced into the wellbore above the single magnet, and upon reaching the magnetic field provided by the magnet, the magnetorheological fluid undergoes viscosification to form a fluid seal.

Figure 4A:
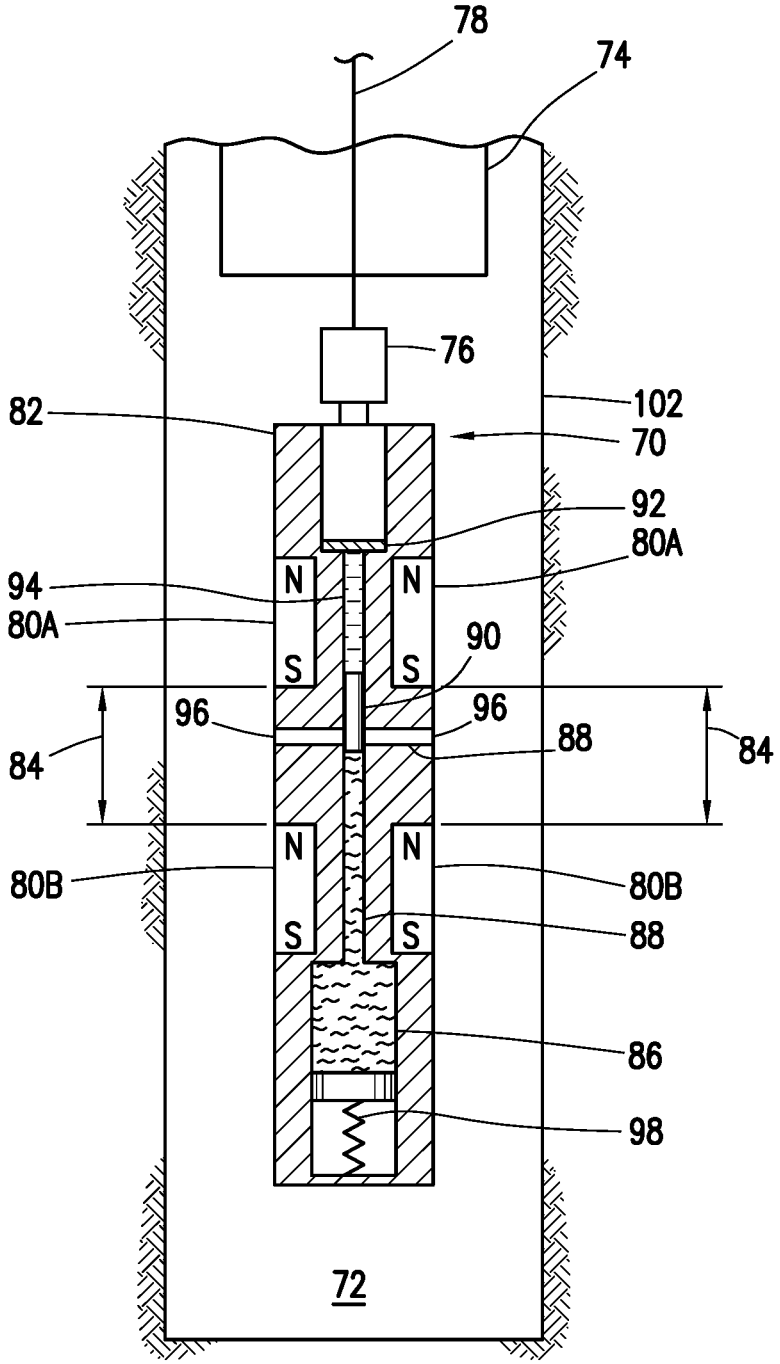
FIGS. 4A and 4B show schematics of a bridge plug apparatus having spaced apart magnets in a fixed configuration.
Figure 4B:
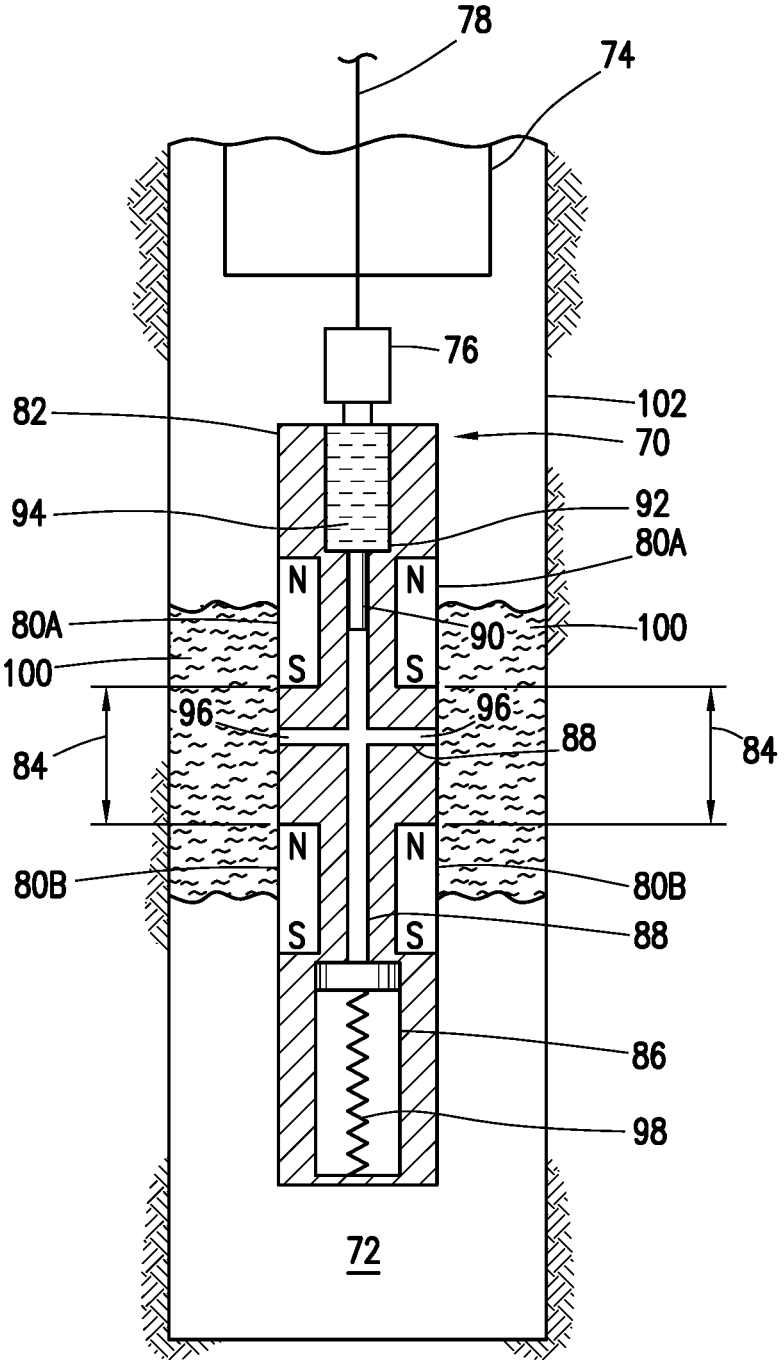

FIGS. 4A and 4B show schematics of a bridge plug apparatus having spaced apart magnets in a fixed configuration. For convenience of discussion, bridge plug apparatus 70 is shown in FIGS. 4A and 4B disposed within wellbore 72 after traversing tubing string 74. Bridge plug apparatus 70 is configured for substantially permanent deployment within wellbore 72 due to its fixed magnet configuration. Upon actuation, the magnetorheological fluid is released from bridge plug apparatus 70 in an unconstrained state and may form a fluid seal upon interaction with a magnetic field within wellbore 72.

FIG. 4A shows the configuration of bridge plug apparatus 70 before displacement of the magnetorheological fluid therefrom. In the configuration of FIG. 4A, the magnetorheological fluid has undergone no substantial viscosification in order to allow it to undergo ready displacement at a desired time. FIG. 4B shows the configuration of bridge plug apparatus 70 after the magnetorheological fluid has been discharged from bridge plug apparatus 70, and substantial viscosification has taken place upon exposure of the magnetorheological fluid to a magnetic field.

As shown in FIGS. 4A and 4B, bridge plug apparatus 70 and setting assembly 76 are conveyed through tubing string 74 via wireline 78 to a location beyond the terminus of tubing string 74. As discussed above, bridge plug apparatus 70 may alternately be deployed within tubing string 74, and introduction modalities other than wireline deployment are also possible. Bridge plug apparatus 70 includes magnets 80A and 80B that are spaced apart from one another and set within housing 82. Gap 84 is defined between magnets 80A and 80B. Flow path 88 extends from reservoir 86 and passes through gap 84, eventually leading to the exterior of housing 82 through opening 96.

In order to maintain the magnetorheological fluid within housing 82 until a desired time, barrier 90 is present within flow path 88. The barrier within flow path 88 may be movable in some embodiments, breakable in other embodiments, degradable in still other embodiments, or any combination thereof. FIGS. 4A and 4B show barrier 90 as a blocking hydraulic piston, although other modalities such as a rupture disk are also possible. Although a blocking hydraulic piston may be readily actuated in the depicted configuration of bridge plug apparatus 70, it is to be recognized that such alternative modalities for regulating fluid flow may also be employed. Further alternative modalities for blocking flow path 88 will be familiar to one having ordinary skill in the art. In the configuration of FIG. 4A, a magnetorheological fluid fills reservoir 86 and flow path 88 up to the location of barrier 90.

A blocking piston, particularly a hydraulic piston, can be particularly suitable for use in blocking flow path 88. Specifically, hydraulic pressure holding a blocking piston in place may be readily released in order to allow displacement of the magnetorheological fluid to take place once flow path 88 has been opened.

In FIG. 4A, bridge plug apparatus 70 also contains electronic rupture disk 92 which, when actuated, releases hydraulic fluid 94 and results in movement of barrier 90 to open flow path 88. Alternative containment devices instead of electronic rupture disk 92 may also be used to maintain hydraulic pressure. Similarly, barrier 90 may also be moved or held in place by non-hydraulic means. For example, a screw-driven piston may be used to block flow path 88 in some embodiments. Likewise, a rupture disk may also be used to directly block flow path 88 in some embodiments, as discussed above.

Optionally, magnetic shielding may be provided between flow path 88 and magnet 80B and/or magnet 80A. Magnetic shielding of flow path 88 may limit premature viscosification of the magnetorheological fluid and allow it to be completely dispensed from opening 96 into wellbore 72. Suitable materials for achieving magnetic shielding will be familiar to one having ordinary skill in the art. In some embodiments, magnetic shielding may be omitted, since the fluid velocity within flow path 88 may be sufficient to overcome any viscosity increases that may occur therein.

To aid in the displacement of the magnetorheological fluid from housing 82, stored energy source 98, such as a spring, for example, is used to apply a compression force to the magnetorheological fluid. More generally, bridge plug apparatus 70 may comprise a structure within housing 82 that applies a compression force to the magnetorheological fluid. Suitable structures may include, for example, a spring-driven piston or a hydraulically-driven piston. A spring-driven piston may be particularly advantageous in this respect, since it will release its energy automatically without need of further actuation upon release of the hydraulic pressure. Prior to actuation of electronic rupture disk 92, the compression force applied by stored energy source 98 is at least counterbalanced by the hydraulic force applied by hydraulic fluid 94.

Upon opening flow path 88 by actuating electronic rupture disk 92, as shown in FIG. 4B, the magnetorheological fluid is displaced from reservoir 86 under the influence of compression force applied by stored energy source 98. After leaving reservoir 86, the magnetorheological fluid traverses flow path 88 and exits housing 82 through opening 96. Opening 96 may initially be covered with a rupture disk or like structure to prevent incursion of wellbore fluids into flow path 88. The rupture disk may comprise a metal foil or plug, a dissolvable film or plug, or the like.

Upon entering wellbore 72 from opening 96, the magnetorheological fluid extends or expands laterally outward and interacts with the magnetic flux lines emanating from magnets 80A and 80B. Magnets 80A and 80B are housed sufficiently close to one another in bridge plug apparatus 70 to result in viscosification and possible solidification of the magnetorheological fluid within wellbore 72. Viscosification of the magnetorheological fluid limits its lateral movement beyond magnets 80A and 80B. Upon viscosification of the magnetorheological fluid, viscosifed mass 100 is formed between wellbore walls 102 and housing 82, as shown in FIG. 4B. Viscosified mass 100 can form a fluid seal within wellbore 72. In some embodiments, viscosified mass 100 may remain substantially permanently deployed in wellbore 72.

Since viscosified mass 100 is substantially unsupported in wellbore 72, it can be desirable to further strengthen viscosified mass 100 to some degree over the strengthening conveyed by magnetization of the magnetic particles alone. In some embodiments, a component of the magnetorheological fluid within bridge plug apparatus 70 may chemically react to further increase its viscosity. Magnetorheological sealants may function in this manner, where the fluid viscosity increases due to both magnetization and a chemical reaction. The chemical reaction conveys strengthening and increased stability to viscosified mass 100 following initial viscosification resulting from magnetization of the magnetically responsive particles. Magnetorheological sealants may be used in bridge plug apparatuses 30 and 50 as well, particularly in configurations where the magnetorheological fluid is unconstrained (see FIG. 2C). The adhesive nature of magnetorheological sealant may also improve conformance of viscosified mass 100 with wellbore walls 102. Magnetorheological sealants include magnetorheological adhesives, further description of which follows below.

A magnetorheological adhesive may be formulated to set at a certain time after dispensation into a wellbore, thereby further strengthening solidified mass 100. In general, magnetorheological adhesives comprise within their carrier fluid a polymer precursor and a plurality of magnetically responsive particles. Before curing of the polymer precursor, the magnetorheological adhesive readily flows, thereby allowing it to be displaced from its original location in a bridge plug apparatus. After magnetization and viscosification of the magnetorheological adhesive has taken place, the polymer precursor can then set, thereby providing further viscosification and strengthening to a fluid seal within a wellbore. The polymer precursor may be chosen to provide a desired setting time based on the conditions that are present in a wellbore. Non-limiting examples of suitable polymer precursors may comprise any material that crosslinks such as, for example, plastics, adhesives, thermoplastic materials, thermosetting resins, elastomeric materials, and the like. Specific polymer precursors may include, for example, epoxy resin precursors, silicones, sealants, oils, gels, glues, acids, thixotropic fluids, diluent fluids, and the like. Both single- and multi-component sealant systems, such as epoxy resins, may be used in the embodiments described herein. In addition, the polymers formed from the polymer precursor may be self-healing in some embodiments in order to mitigate damage produced by over-flexing, over-pressurization, cracking, void formation, and the like. For example, a healing agent may be deployed in a hollow container in the polymer, and the healing agent may be released upon exposure to particular damage-inducing conditions in the wellbore. Multi-component sealant systems may be released from the same or different location within the bridge plug apparatus.

Other suitable magnetorheological sealants making use of a chemical reaction during setting are non-polymeric in nature. In some embodiments, the magnetorheological sealant may utilize a hydration chemical reaction in the course of increasing the viscosity. Examples of suitable materials that may undergo a hydration chemical reaction include cement, calcium oxides, and silicates. As described above, such magnetorheological sealants can be carried within the bridge plug apparatus during its deployment in a subterranean formation. Alternatively, such magnetorheological sealants may also be pumped into the wellbore after the slips on the bridge plug apparatus have been set.

Magnetic particles suitable for use in the magnetorheological fluids described herein are generally particles that are attracted to a magnetic field. In some embodiments, the magnetic particles comprise a ferromagnetic material such as iron, nickel, cobalt, or any combination thereof. Paramagnetic, superparamagnetic, or diamagnetic materials may also be suitable in some embodiments. In various embodiments, the magnetic particles may range between about 10 nm and about 100 microns in size. In more particular embodiments, the magnetic particles may range between about 100 nm and about 1 micron in size, or between about 1 micron and about 10 microns in size, or between about 10 microns and about 100 microns in size. In some embodiments, the magnetic particles may range between about 10 nm to about 100 nm in size. Iron particles in a size range of 10 nm to 100 nm in size can be superparamagnetic. Paramagnetic and superparamagnetic materials may be particularly suitable for the retrievable bridge plug apparatus configurations disclosed herein. The magnetic particles may be of any suitable shape such as, for example, spherical, spheroidal, tubular, corpuscular, fibrous, oblate spheroidal and any combination of such particles.

In some embodiments, a surfactant may be present in the magnetorheological fluid. Inclusion of a surfactant in the magnetorheological fluid may discourage settling or agglomeration of the magnetic particles within the fluid. Suitable surfactants will be familiar to one having ordinary skill in the art.

In some embodiments, the surface of the magnetically responsive particles can also be coated or functionalized. Coating or functionalization can provide many advantages, such as promoting better bonding with a cured magnetorheological sealant and/or providing a reduced viscosity in the first viscosity state. Suitable coatings and functionalization moieties are not believed to be particularly limited and will be recognized by one having ordinary skill in the art. In some embodiments, a suitable coating for the magnetically responsive particles may comprise a silane coating.

Any suitable type of magnet may be used in the embodiments described herein. In some embodiments, the magnets may comprise permanent magnets. In alternative embodiments, the magnets may comprise electromagnets. Use of permanent magnets may be advantageous in the embodiments described herein so that a source of downhole power does not have to be supplied in order to establish a magnetic field. Any suitable magnet configuration such as ring magnets, disk magnets, block magnets, and the like may be used in the embodiments described herein. For example, in some embodiments, ring magnets may extend circumferentially around the diameter of the bridge plug apparatuses of the present disclosure to provide a space-apart magnet configuration. In other embodiments, block magnets may be placed circumferentially around the diameter of the bridge plug apparatuses to provide a spaced-apart magnet configuration. In some embodiments, the spaced-apart magnets have opposite poles facing each other.

In still other alternative configurations, bridge plug apparatuses having a single magnet disposed circumferentially about their housing are described herein. Upon exposure of magnetorheological fluid to the radially projecting magnetic field provided by the magnet, magnetorheological fluid can undergo viscosification from a first viscosity state to a second viscosity state. Both magnetorheological fluids and magnetorheological sealants may be used in such embodiments, although magnetorheological sealants, particularly magnetorheological adhesives, may be particularly advantageous. In such embodiments, the magnetorheological fluid may be carried in the housing and disposed axially into the wellbore, of the magnetorheological fluid may be pumped into the wellbore separately in order to reach the radially projecting magnetic field.

As alluded to above, the bridge plug apparatuses described herein may be used in various applications to form a fluid seal within a wellbore. Both temporary and permanent fluid seals formed by the bridge plug apparatuses of the present disclosure may be used in this regard.

In some embodiments, methods described herein may comprise: introducing into a wellbore penetrating a subterranean formation: a bridge plug apparatus comprising spaced apart magnets having a gap defined therebetween, and a reservoir of magnetorheological fluid in a first viscosity state housed within the gap; and laterally moving the magnets toward one another to contract the gap and to displace the reservoir of magnetorheological fluid radially outward from the gap and into the wellbore. The magnetorheological fluid has a second viscosity state once displaced from the gap, where the second viscosity state has a higher viscosity than the first viscosity state. In some embodiments, the magnets may be laterally moved sufficiently close to one another to solidify the magnetorheological fluid once displaced from the gap.

In some embodiments, the reservoir of magnetorheological fluid displaced into the wellbore may form a fluid seal therein. For example, in some embodiments, the magnetorheological fluid may solidify to a viscoelastic solid between the bridge plug apparatus and the wellbore walls to form a fluid seal. Accordingly, in some embodiments, methods of the present disclosure may further comprise forming a fluid seal in the wellbore with the magnetorheological fluid in the second viscosity state, the fluid seal being defined between the bridge plug apparatus and the walls of the wellbore.

In some embodiments, the reservoir of magnetorheological fluid may be housed in a deformable container within the gap. In such embodiments, the deformable container may also be displaced radially outward from the gap and into the wellbore upon laterally moving the magnets toward one another. For example, in some embodiments, the deformable container may comprise a bladder-like structure that outwardly deforms upon compression. Since the magnetorheological fluid remains constrained within the deformable container in such embodiments, the bridge plug apparatus may be retrieved by laterally moving the magnets apart from one another and withdrawing the deformable container and magnetorheological fluid back into the gap. When the magnetorheological fluid and deformable container are displaced from the gap, the methods may further comprise contacting the deformable container with the walls of the wellbore to form a fluid seal in the wellbore with the magnetorheological fluid in the second viscosity state.

In alternative embodiments, the reservoir of magnetorheological fluid may be housed in a degradable container within the gap. In such embodiments, the degradable container may breach upon moving the magnets toward one another, thereby releasing the magnetorheological fluid into the wellbore in an unconstrained state. Alternately, a degradable container may degrade or erode away after viscosification of the magnetorheological fluid in the wellbore. Thus, in such embodiments, a degradable container may initially constrain the magnetorheological fluid in the wellbore before leaving the viscosified magnetorheological fluid in an unconstrained state in the wellbore thereafter. When the magnetorheological fluid is released into the wellbore in an unconstrained state, the bridge plug apparatuses may be deployed in a substantially permanent manner in the wellbore.

In some embodiments, a support structure may be affixed to at least one of the magnets, where the support structure restricts axial movement of the deformable or degradable container as it is displaced from the gap. Particularly, the support structure may pivot as the deformable or degradable container is displaced from the gap. As discussed above, the support structure can convey additional mechanical strengthening to a fluid seal formed from the viscosified magnetorheological fluid and the deformable container. In some embodiments, the support structure may be configured to reversibly pivot and contract as the magnetorheological fluid and deformable container are withdrawn back into the gap between the spaced-apart magnets.

In some embodiments, methods of the present disclosure may comprise producing or servicing a subterranean zone upstream of the fluid seal formed by the bridge plug apparatus. For example, if a downstream subterranean zone is producing an undesired subterranean fluid (e.g., water), a bridge plug apparatus of the present disclosure may be introduced to a wellbore (e.g., through a tubing string), and the bridge plug apparatus may form a fluid seal that can temporarily or permanently shut off fluid flow from the offending subterranean zone. Similarly, an upstream subterranean zone may be treated in order to enhance production therefrom.

In some embodiments, methods of the present disclosure may comprise performing a cementing operation upstream of the fluid seal. For example, a bridge plug apparatus of the present disclosure may be used to deploy a fluid seal in a wellbore and a cement column may be applied upon the viscosified magnetorheological fluid. That is, in such embodiments, cement may be applied to an upstream face of the fluid seal. The viscosified magnetorheological fluid can provide a sufficiently robust surface to form a cement plug in the subterranean formation and permanently shut off fluid flow from a location downstream of the cement plug. Bridge plug apparatus configurations for permanent deployment may be more robust for cementing operations, although the retrievable configurations may also be used in alternative embodiments. In embodiments where a magnetorheological sealant is used, the cement may be disposed on an upper surface of the magnetorheological fluid after chemically reacting a component of the magnetorheological fluid to further increase its viscosity.

As indicated above, in configurations where the magnetorheological fluid remains constrained within a deformable container, the bridge plug apparatus may be retrieved from the wellbore. Accordingly, in some embodiments, methods of the present disclosure may comprise laterally moving the magnets apart from one another to expand the gap and retract the reservoir of magnetorheological fluid toward the gap. As the magnets are moved apart from one another, the magnetorheological fluid contracts and enters a third viscosity state upon being retracted. The third viscosity state has a lower viscosity than the second viscosity state. That is, by laterally moving the magnets apart from one another the magnetorheological fluid may be at least partially de-viscosified, thereby allowing the bridge plug apparatus to be moved and/or withdrawn from the wellbore. The third viscosity state may have the same viscosity as the first viscosity state, or the first viscosity state and the third viscosity state may be different.

In still other embodiments of the present disclosure, methods for deploying a bridge plug apparatus in a wellbore may comprise: introducing into a wellbore penetrating a subterranean formation, a bridge plug apparatus containing: a housing containing a reservoir of magnetorheological fluid, a flow path extending between the reservoir and the exterior of the housing, a barrier located within the flow path that temporarily blocks the flow path, and space apart magnets disposed within the housing and having a gap defined therebetween, at least a portion of the flow path being located within the gap defined between the magnets; wherein the magnetorheological fluid is in a first viscosity state in the reservoir; opening the flow path by displacing the barrier; and applying a compression force to the magnetorheological fluid to displace the magnetorheological fluid from the reservoir to the wellbore; wherein the magnetorheological fluid has a second viscosity state within the wellbore, the second viscosity state having a higher viscosity than the first viscosity state.

In some embodiments, the barrier within the flow path may comprise a hydraulic piston, such as an electrically actuated hydraulic piston. In other embodiments, the barrier within the flow path may comprise a rupture disk. In some embodiments, the compression force to the magnetorheological fluid can be applied by a spring-driven piston or a hydraulically-driven piston.

In still other embodiments, methods described herein may comprise: introducing into a wellbore penetrating a subterranean formation, bridge plug apparatus comprising: a housing, and a magnet disposed circumferentially about the housing, the magnet providing a radially projecting magnetic field; disposing a magnetorheological fluid into the radially projecting magnetic field to increase the viscosity of the magnetorheological fluid from a first viscosity state to a second viscosity state; and chemically reacting a component of the magnetorheological fluid to further increase the viscosity of the magnetorheological fluid.

Embodiments disclosed herein include:

A. Bridge plug apparatuses that viscosify a magnetorheological fluid by lateral movement of magnets with respect to one another. The bridge plug apparatuses comprise: spaced apart magnets having a gap defined therebetween; and a reservoir of magnetorheological fluid housed within the gap; wherein the magnets move laterally with respect to one another to expand or contract the gap and to displace the reservoir of magnetorheological fluid radially with respect to the magnets.

B. Methods for using bridge plug apparatuses to form a fluid seal by lateral movement of magnets with respect to one another. The methods comprise: introducing a bridge plug apparatus into a wellbore penetrating a subterranean formation, the bridge plug apparatus comprising: spaced apart magnets having a gap defined therebetween, and a reservoir of magnetorheological fluid in a first viscosity state housed within the gap; and laterally moving the magnets toward one another to contract the gap and to displace the reservoir of magnetorheological fluid radially outward from the gap and into the wellbore; wherein the magnetorheological fluid has a second viscosity state once displaced from the gap, the second viscosity state having a higher viscosity than the first viscosity state.

C. Bridge plug apparatuses that viscosify a magnetorheological fluid using magnets that are in a fixed configuration with respect to one another. The bridge plug apparatuses comprise: a housing containing a reservoir of magnetorheological fluid; a flow path extending between the reservoir and an exterior surface of the housing, the flow path fluidly connecting the reservoir to the exterior surface; a barrier located within the flow path that temporarily blocks the flow path; and spaced apart magnets disposed within the housing and having a gap defined therebetween, at least a portion of the flow path being located within the gap defined between the magnets; wherein the bridge plug apparatuses are configured to pass through the interior of a tubing string within a wellbore.

D. Methods for using bridge plug apparatuses to form a fluid seal with magnets that are in a fixed configuration with respect to one another. The methods comprise: introducing a bridge plug apparatus into a wellbore penetrating a subterranean formation, the bridge plug apparatus comprising: a housing containing a reservoir of magnetorheological fluid, a flow path extending between the reservoir and an exterior surface of the housing, a barrier located within the flow path that temporarily blocks the flow path, and spaced apart magnets disposed within the housing and having a gap defined therebetween, at least a portion of the flow path being located within the gap defined between the magnets; wherein the wellbore contains a tubing string and the bridge plug apparatus is introduced through the tubing string to a location in the wellbore downstream of the tubing string; and wherein the magnetorheological fluid is in first viscosity state in the reservoir; opening the flow path by displacing the barrier; and applying a compression force to the magnetorheological fluid to displace the magnetorheological fluid from the reservoir to the wellbore; wherein the magnetorheological fluid has a second viscosity state within the wellbore, the second viscosity state having a higher viscosity than the first viscosity state.

E. Methods for forming a fluid seal using a chemical reaction of a component of a magnetorheological fluid. The methods comprise: introducing a bridge plug apparatus into a wellbore penetrating a subterranean formation, the bridge plug apparatus comprising: a housing, and a magnet disposed circumferentially about the housing, the magnet providing a radially projecting magnetic field; wherein the wellbore contains a tubing string and the bridge plug apparatus is introduced through the tubing string to a location in the wellbore downstream of the tubing string; disposing a magnetorheological fluid into the radially projecting magnetic field to increase the viscosity of the magnetorheological fluid from a first viscosity state to a second viscosity state; and chemically reacting a component of the magnetorheological fluid to further increase the viscosity of the magnetorheological fluid.

Each of embodiments A-E may have one or more of the following additional elements in any combination:

Element 1: wherein the magnets have opposite poles facing each other.

Element 2: wherein the reservoir of magnetorheological fluid is housed in a deformable container within the gap.

Element 3: wherein the bridge plug apparatus further comprises a support structure affixed to at least one of the magnets, the support structure restricting axial movement of the deformable container as it is displaced from the gap.

Element 4: wherein the support structure pivots as the deformable container expands or contracts upon lateral movement of the magnets with respect to one another.

Element 5: wherein the magnets are laterally movable toward one another at least to a separation distance where the magnetorheological fluid has an increased viscosity outside the gap compared to its viscosity inside the gap.

Element 6: wherein the magnets are permanent magnets.

Element 7: wherein the magnetorheological fluid comprises a magnetorheological adhesive.

Element 8: wherein the bridge plug apparatus further comprises a support structure affixed to at least one of the magnets, the support structure restricting axial movement of the magnetorheological fluid as it is displaced from the gap; wherein the support structure pivots upon lateral movement of the magnets with respect to one another.

Element 9: wherein the method further comprises: forming a fluid seal in the wellbore with the magnetorheological fluid in the second viscosity state, the fluid seal being defined between the bridge plug apparatus and the walls of the wellbore.

Element 10: wherein the magnets are laterally moved sufficiently close to one another to solidify the magnetorheological fluid once displaced from the gap.

Element 11: wherein the reservoir of magnetorheological fluid is housed in a deformable container within the gap, and the method further comprises displacing the deformable container radially outward from the gap and into the wellbore upon laterally moving the magnets toward one another.

Element 12: wherein the method further comprises: contacting the walls of the wellbore with the deformable container to form a fluid seal in the wellbore with the magnetorheological fluid in the second viscosity state.

Element 13: wherein the method further comprises: producing or servicing a subterranean zone upstream of the fluid seal.

Element 14: wherein the method further comprises: performing a cementing operation upstream of the fluid seal.

Element 15: wherein a support structure is affixed to at least one of the magnets, the support structure restricting axial movement of the deformable container as it is displaced from the gap.

Element 16: wherein the support structure pivots as the deformable container is displaced from the gap.

Element 17: wherein the wellbore contains a tubing string and the bridge plug apparatus is introduced through the tubing string to a location in the wellbore downstream of the tubing string.

Element 18: wherein the method further comprises: laterally moving the magnets apart from one another to expand the gap and to retract the reservoir of magnetorheological fluid toward the gap; wherein the magnetorheological fluid attains a third viscosity state upon being retracted, the third viscosity state having a lower viscosity than the second viscosity state.

Element 19: wherein the bridge plug apparatus further comprises: a structure within the housing that applies a compression force to the magnetorheological fluid.

Element 20: wherein the structure comprises a spring-driven piston or a hydraulically-driven piston.

Element 21: wherein the barrier comprises a hydraulic piston or a rupture disk.

Element 22: wherein the magnetorheological fluid in the second viscosity state forms a fluid seal within the wellbore, the fluid seal being defined between the bridge plug apparatus and the walls of the wellbore.

Element 23: wherein cement is applied to an upstream face of the fluid seal and cured.

Element 24: wherein the magnetorheological fluid solidifies in the wellbore.

Element 25: wherein the magnetorheological fluid is carried in the housing and is disposed axially into the wellbore.

Element 26: wherein the magnetorheological fluid is pumped into the wellbore.

Element 27: wherein the method further comprises: disposing cement on an upper surface of the magnetorheological fluid after chemically reacting the component of the magnetorheological fluid to further increase its viscosity.

By way of non-limiting example, exemplary combinations applicable to A-E include:

The bridge plug apparatus of A or the method of B in combination with elements 2 and 6.

The bridge plug apparatus of A or the method of B in combination with elements 2, 3 and 4.

The bridge plug apparatus of A or the method of B in combination with elements 5 and 6.

The bridge plug apparatus of A or the method of B in combination with elements 5 and 7.

The method of B in combination with elements 9 and 10.

The method of B in combination with elements 11 and 12.

The method of B in combination with elements 9 and 13.

The method of B in combination with elements 9 and 14.

The method of B in combination with elements 11 and 17.

The bridge plug apparatus of C or the method of D in combination with elements 6 and 7.

The bridge plug apparatus of C or the method of D in combination with elements 7 and 21.

The bridge plug apparatus of C in combination with elements 19-21.

The bridge plug apparatus of C in combination with elements 7 and 19-21.

The method of D in combination with elements 7 and 22.

The method of D in combination with elements 7 and 13.

The method of D in combination with elements 7 and 14.

The method of D in combination with elements 7, 14 and 23.

The method of E in combination with elements 7 and 25.

The method of E in combination with elements 7 and 26.

The method of E in combination with elements 7 and 27.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A bridge plug apparatus comprising:

spaced apart magnets having a gap defined therebetween;

a reservoir of magnetorheological fluid housed within the gap; wherein the magnets move laterally with respect to one another to expand or contract the gap and to displace the reservoir of magnetorheological fluid radially with respect to the magnets; wherein the magnets are laterally movable toward one another at least to a separation distance where the magnetorheological fluid has an increased viscosity outside the gap compared to its viscosity inside the gap; wherein the reservoir of magnetorheological fluid is housed in a deformable container within the gap; wherein the deformable container is configured to degrade away after viscosification of the magnetorheological fluid in the gap; wherein the magnetorheological fluid further comprises a cross-linkable polymer precursor configured to cure and set in the gap such that the bridge plug remains permanently deployed in a wellbore; wherein the cross-linkable polymer precursor is selected from the group consisting of plastics, adhesives, thermoplastic materials, thermosetting resins, elastomeric materials, and any combination thereof; and a support structure comprising petal plates which unfurl to pivot radially outward away from the gap to accommodate outward displacement of the magnetorheological fluid and further restricts axial movement of the magnetorheological fluid as it is displaced from the gap; wherein at least a portion of the support structure is affixed directly to the magnets such that the support structure contacts the magnets.

2. The bridge plug apparatus of claim 1, wherein the magnets have opposite poles facing each other.

3. The bridge plug apparatus of claim 1, further comprising:

wherein the support structure restrict axial movement of the deformable container as it is displaced from the gap.

4. The bridge plug apparatus of claim 3, wherein the support structure pivots as the deformable container expands or contracts upon lateral movement of the magnets with respect to one another.

5. The bridge plug apparatus of claim 1, wherein the magnets are permanent magnets.

6. The bridge plug apparatus of claim 1, wherein the magnetorheological fluid comprises a magnetorheological adhesive.

7. The bridge plug apparatus of claim 1, further comprising:

wherein the support structure pivots upon lateral movement of the magnets with respect to one another.

8. A method comprising:

introducing a bridge plug apparatus into a wellbore penetrating a subterranean formation, the bridge plug apparatus comprising:

a housing, spaced apart magnets having a gap defined therebetween, the magnets disposed circumferentially about the housing, the magnets providing a radially projecting magnetic field;

a support structure comprising petal plates which unfurl to pivot radially outward away from the gap to accommodate outward displacement of the magnetorheological fluid and further restricts axial movement of the magnetorheological fluid as it is displaced from the gap; wherein at least a portion of the support structure is affixed directly to the magnets such that the support structure contacts the magnets;

and wherein the wellbore contains a tubing string and the bridge plug apparatus is introduced through the tubing string to a location in the wellbore downstream of the tubing string;

disposing a magnetorheological fluid into the radially projecting magnetic field to increase the viscosity of the magnetorheological fluid from a first viscosity state to a second viscosity state; wherein the magnetorheological fluid is disposed in the gap between the magnets;

chemically reacting a component of the magnetorheological fluid to further increase the viscosity of the magnetorheological fluid; wherein the magnetorheological fluid further comprises a cross-linkable polymer precursor configured to cure; wherein the cross-linkable polymer precursor is selected from the group consisting of plastics, adhesives, thermoplastic materials, thermosetting resins, elastomeric materials, and any combination thereof; and curing the cross-linkable polymer precursor in the gap such that the bridge plug remains permanently deployed in the wellbore.

9. The method of claim 8, wherein the magnetorheological fluid comprises a magnetorheological adhesive.

10. The method of claim 8, wherein the magnetorheological fluid is carried in the housing and is disposed axially into the wellbore.

11. The method of claim 8, wherein the magnetorheological fluid is pumped into the wellbore.

12. The method of claim 8, further comprising:

disposing cement on an upper surface of the magnetorheological fluid after chemically reacting the component of the magnetorheological fluid to further increase its viscosity.

* * * * *